US010386082B2

(12) United States Patent
Aoyama

(10) Patent No.: US 10,386,082 B2
(45) Date of Patent: Aug. 20, 2019

(54) OUTDOOR UNIT

(71) Applicant: Mitsubishi Electric Corporation, Tokyo (JP)

(72) Inventor: Yutaka Aoyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/738,216

(22) PCT Filed: Jul. 19, 2016

(86) PCT No.: PCT/JP2016/071157
§ 371 (c)(1),
(2) Date: Dec. 20, 2017

(87) PCT Pub. No.: WO2017/018272
PCT Pub. Date: Feb. 2, 2017

(65) Prior Publication Data

US 2018/0180306 A1 Jun. 28, 2018

(30) Foreign Application Priority Data

Jul. 29, 2015 (WO) ..... PCT/JP2015/071534

(51) Int. Cl.
*F24F 1/36* (2011.01)
*F24F 11/42* (2018.01)
(Continued)

(52) U.S. Cl.
CPC ..... *F24F 1/36* (2013.01); *F24F 11/42* (2018.01); *F24F 13/22* (2013.01); *F25B 13/00* (2013.01);
(Continued)

(58) Field of Classification Search
CPC ..... F24F 1/36; F24F 11/42; F25B 47/025; F25B 47/022; F25B 13/00; F25B 47/02
See application file for complete search history.

(56) References Cited

U.S. PATENT DOCUMENTS

2003/0066300 A1* 4/2003 Takeuchi ..... B60H 1/3204 62/191
2014/0224457 A1 8/2014 Suzuki et al.
2014/0338384 A1* 11/2014 Koike ..... F24F 13/222 62/285

FOREIGN PATENT DOCUMENTS

JP 53-097756 U1 8/1978
JP 58-120059 A 7/1983
(Continued)

OTHER PUBLICATIONS

Office action dated Jun. 19, 2018 issued in corresponding JP patent application No. 2017-530798 (and English translation thereof).
(Continued)

*Primary Examiner* — Ana M Vazquez
(74) *Attorney, Agent, or Firm* — Posz Law Group, PLC

(57) ABSTRACT

An outdoor unit being part of a refrigeration cycle apparatus in which refrigerant circulates and having a maintenance opening port includes an open-close panel configured to cover the maintenance opening port by being attached openably and closably to the outdoor unit, a heat source side heat exchanger disposed above the maintenance opening port and provided at least with an open-close panel-facing heat exchange unit facing a plane containing the open-close panel, a drainage channel located at least below the open-close panel-facing heat exchange unit of the heat source side heat exchanger, wherein the heating energy supply unit includes a refrigerant pipe configured to pass refrigerant
(Continued)

higher in temperature than a freezing point of water in an upstream direction from a downstream direction of the drainage channel.

14 Claims, 11 Drawing Sheets

(51) Int. Cl.
*F24F 13/22* (2006.01)
*F25B 47/02* (2006.01)
*F25B 13/00* (2006.01)

(52) U.S. Cl.
CPC ..... *F25B 47/02* (2013.01); *F25B 47/022* (2013.01); *F25B 47/025* (2013.01); *F25B 2313/0253* (2013.01); *F25B 2313/02731* (2013.01); *F25B 2313/02741* (2013.01)

(56) References Cited

FOREIGN PATENT DOCUMENTS

| | | | |
|---|---|---|---|
| JP | 2004-085178 | A | 3/2004 |
| JP | 2006125651 | A | 5/2006 |
| JP | 2008-202889 | A | 9/2008 |
| JP | 2009079851 | A | 4/2009 |
| JP | 2014-115007 | A | 6/2014 |
| WO | 2013/046724 | A1 | 4/2013 |
| WO | 2013/051177 | A1 | 4/2013 |

OTHER PUBLICATIONS

International Search Report dated Oct. 4, 2016 issued in corresponding International application No. PCT/JP2016/071157.

* cited by examiner

OUTDOOR UNIT

CROSS REFERENCE TO RELATED APPLICATION

This application is a U.S. national stage application of International Application No. PCT/JP2016/071157, filed on Jul. 19, 2016, and claims priority from International Application No. PCT/JP2015/071534, filed on Jul. 29, 2015, the contents of which are incorporated herein by reference.

TECHNICAL FIELD

The present invention relates to an outdoor unit in which a drainage channel is disposed below a heat source side heat exchanger.

BACKGROUND

In a conventional outdoor unit, water, such as condensation water generated in a heat exchanger or rainwater, runs down fins of the heat exchanger, drops from a lower end of the heat exchanger, and is drained through a hole formed in a base panel (see, for example, Patent Literature 1).

PATENT LITERATURE

Patent Literature 1: Japanese Unexamined Patent Application Publication No. 2009-79851

However, with a conventional outdoor unit such as that described in Patent Literature 1, there is a risk that in low outdoor temperatures or the like, if water freezes, an open-close panel attached openably and closably may freeze or the like.

SUMMARY

The present invention has been made in view of the above problem and has an object to provide an outdoor unit in which a risk of an open-close panel being frozen is reduced.

An outdoor unit according to one embodiment of the present invention is an outdoor unit being part of a refrigeration cycle apparatus in which refrigerant circulates and having a maintenance opening port, comprising: an open-close panel attached openably and closably to the outdoor unit and configured to cover the maintenance opening port; a heat source side heat exchanger disposed above the maintenance opening port and provided at least with an open-close panel-facing heat exchange unit facing a plane containing the open-close panel; a drainage channel provided with a first drainage unit, the first drainage unit being located at least below the open-close panel-facing heat exchange unit of the heat source side heat exchanger and inclined downward toward a plane other than the plane containing the open-close panel; and a heating energy supply unit disposed adjacent to, or in abutment with, at least part of the drainage channel, wherein the heating energy supply unit includes a refrigerant pipe configured to pass refrigerant higher in temperature than a freezing point of water in an upstream direction from a downstream direction of the drainage channel An embodiment of the present invention provides an outdoor unit in which a risk of the open-close panel being frozen is reduced.

DETAILED DESCRIPTION

Figure 1:
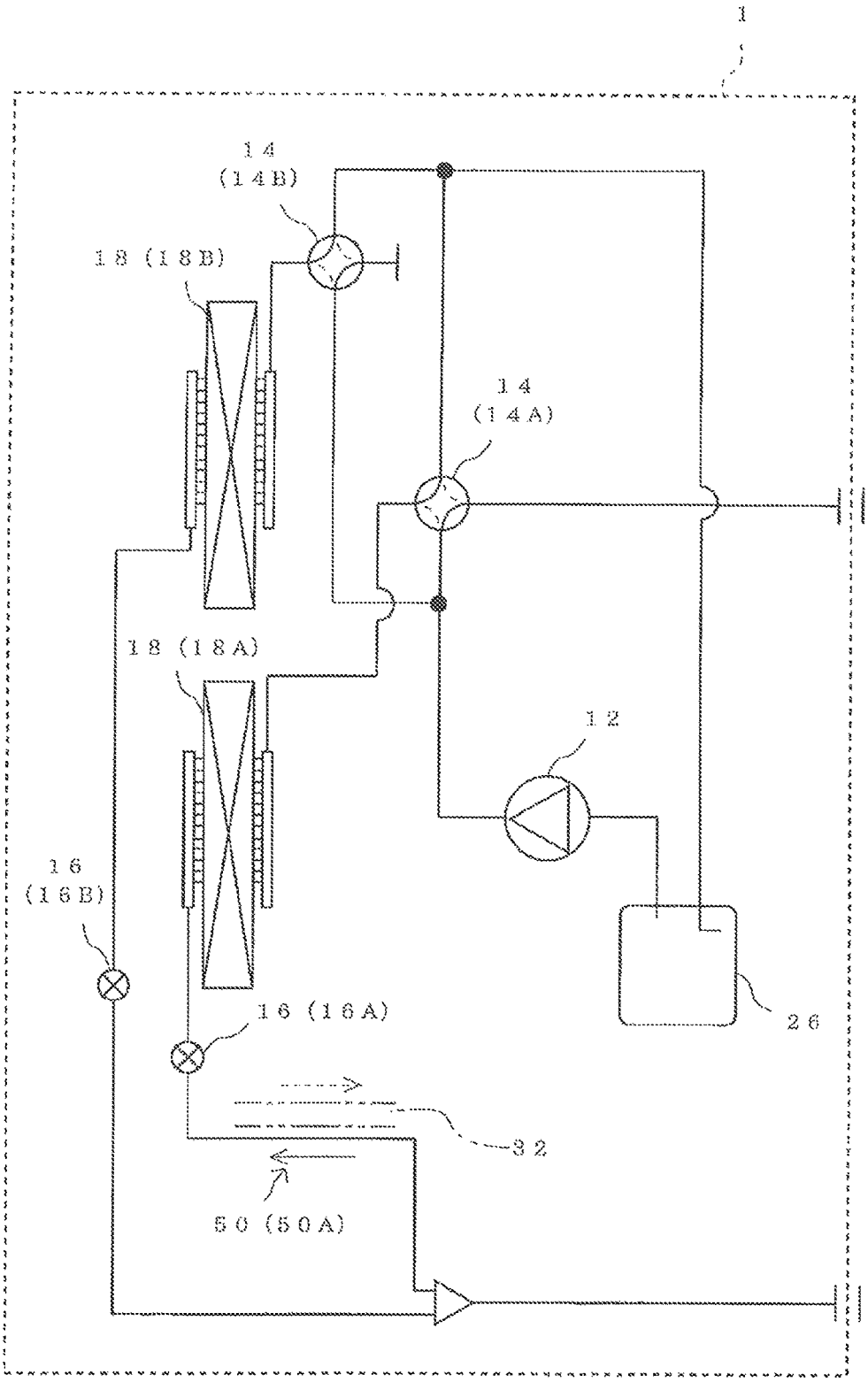
FIG. 1 is a diagram showing an example of a configuration of an outdoor unit according to Embodiment 1 of the present invention.

Embodiments of the present invention will be described below with reference to the drawings. Note that in each drawing, the same or equivalent components are denoted by the same reference numerals, and description thereof will be omitted or simplified as appropriate. Also, shapes, sizes, arrangement, and the like of the components described in each drawing can be changed as appropriate within the scope of the present invention.

Embodiment 1

[Refrigeration Cycle Apparatus]

Figure 2:
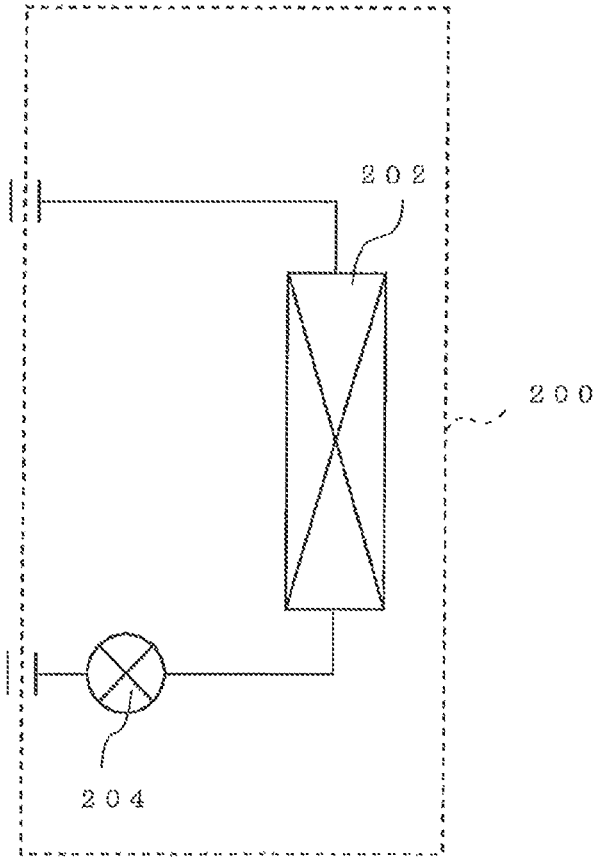
FIG. 2 is a diagram showing an example of a configuration of an indoor unit connected to the outdoor unit shown in FIG. 1.

FIG. 1 is a diagram showing an example of a configuration of an outdoor unit according to Embodiment 1 of the present invention and FIG. 2 is a diagram showing an example of a configuration of an indoor unit connected to the outdoor unit shown in FIG. 1. A refrigeration cycle apparatus (not illustrated) is configured by interconnecting the outdoor unit 1 shown in FIG. 1 and the indoor unit 200 shown in FIG. 2 using refrigerant pipes. The refrigeration cycle apparatus is, for example, an air-conditioning device configured to condition indoor air in a room. As the outdoor unit 1 and indoor unit 200 are interconnected via the refrigerant pipes, at least a compressor 12, a flow path selector 14, a use side heat exchanger 202, an expansion device 204, and a heat source side heat exchanger 18 are interconnected via the refrigerant pipes, forming a refrigerant circuit in which refrigerant circulates.

[Indoor Unit]

The indoor unit 200 shown in FIG. 2 is installed in a room or the like to be air-conditioned and equipped, for example, with the use side heat exchanger 202 and expansion device 204. The use side heat exchanger 202 is designed to exchange heat, for example, between refrigerant and air, and is configured to include, for example, a heat transfer tube through which the refrigerant flows, and plurality of fins attached to the heat transfer tube. An indoor fan (not illustrated) configured to send air to the use side heat exchanger 202 is installed in a neighborhood of the use side heat exchanger 202. The expansion device 204 is designed to expand refrigerant and is, for example, an LEV (linear electronic expansion valve) whose opening degree is adjustable, but may be a capillary tube or the like whose opening degree cannot be adjusted.

[Outdoor Unit]

The outdoor unit 1 shown in FIG. 1 is connected, for example, with the indoor unit 200 shown in FIG. 2 via the refrigerant pipes, thereby being part of the refrigeration cycle apparatus. The outdoor unit 1 is installed outdoors outside the room and functions as a heat source apparatus configured to discharge or supply heat produced by air-conditioning. The outdoor unit 1 includes a compressor 12, a first flow path selector 14A, a second flow path selector 14B, a first decompressor 16A, a second decompressor 16B, a first heat source side heat exchanger 18A, a second heat source side heat exchanger 18B, and an accumulator 26. Note that in the following description, for ease of understanding of the present embodiment, the first flow path selector 14A and second flow path selector 14B may be referred to simply as a flow path selector 14, the first decompressor 16A and second decompressor 16B may be referred to simply as a decompressor 16, and the first heat source side heat exchanger 18A and second heat source side heat exchanger 18B may be referred to simply as a heat source side heat exchanger 18.

The compressor 12 is designed to suck and compress refrigerant, and then discharge the refrigerant in a high-temperature, high-pressure state. The compressor 12 is, for example, a capacity-controllable inverter compressor, but may be of a constant velocity type. The flow path selector 14 is designed to switch between heating flow path and cooling flow path according to operation mode, which is switched between cooling operation and heating operation, and is made up, for example, of a four-way valve. The flow path selector 14 may be configured by combining plural two-way valves or the like.

The decompressor 16 is designed to decompress the refrigerant caused to flow into the heat source side heat exchanger 18 and is, for example, a motor-operated valve whose opening degree is adjustable, but may be a capillary tube or the like whose opening degree cannot be adjusted. The heat source side heat exchanger 18 is designed to exchange heat between refrigerant and air, and is configured to include, for example, a heat transfer tube through which the refrigerant flows, and plurality of fins attached to the heat transfer tube. The heat transfer tube has, for example, a circular or flat shape. The fins are disposed in a direction parallel to a direction in which air flows. The accumulator 26 is designed to accumulate the refrigerant and is connected to a suction side of the compressor 12. Of the refrigerant accumulated in the accumulator 26, the compressor 12 sucks gas refrigerant.

Next, an operation example of the outdoor unit 1 will be described.

[Cooling Operation]

First, an operation example of the outdoor unit 1 during cooling operation will be described. When cooling operation is performed, each of the first flow path selector 14A and second flow path selector 14B shown in FIG. 1 is interconnecting flow paths as indicated by dashed lines. That is, the first flow path selector 14A and second flow path selector 14B are connecting a discharge side of the compressor 12 to the first heat source side heat exchanger 18A and second heat source side heat exchanger 18B while connecting the suction side of the compressor 12 to the use side heat exchanger 202 of the indoor unit 200 shown in FIG. 2 via the accumulator 26. The refrigerant compressed by the compressor 12 shown in FIG. 1 flows through the first heat source side heat exchanger 18A and second heat source side heat exchanger 18B via the first flow path selector 14A and second flow path selector 14B. The refrigerant condensed by flowing through the first heat source side heat exchanger 18A and second heat source side heat exchanger 18B flows out of the outdoor unit 1 and flows into the indoor unit 200 shown in FIG. 2. The refrigerant flowing into the indoor unit 200 is expanded in the expansion device 204 and flows through the use side heat exchanger 202. The refrigerant evaporated while flowing through the use side heat exchanger 202 flows out of the indoor unit 200 and flows into the outdoor unit 1 shown in FIG. 1. The refrigerant flowing into the outdoor unit 1 is accumulated in the accumulator 26 via the first flow path selector 14A. The refrigerant accumulated in the accumulator 26 is sucked into the compressor 12 and compressed again.

[Heating Operation]

Next, an operation example of the outdoor unit 1 during heating operation will be described. When heating operation is performed, each of the first flow path selector 14A and second flow path selector 14B shown in FIG. 1 is interconnecting flow paths as indicated by solid lines. That is, the first flow path selector 14A and second flow path selector 14B are connecting the discharge side of the compressor 12 to the use side heat exchanger 202 of the indoor unit 200 shown in FIG. 2 while connecting the suction side of the compressor 12 shown in FIG. 1 to the first heat source side heat exchanger 18A and second heat source side heat exchanger 18B via the accumulator 26. The refrigerant compressed by the compressor 12 flows out of the outdoor unit 1 via the first flow path selector 14A and flows into the indoor unit 200 shown in FIG. 2. The refrigerant flowing into the indoor unit 200 flows to the use side heat exchanger 202, condensed, and expanded in the expansion device 204. The refrigerant expanded in the expansion device 204 flows out of the indoor unit 200 and flows into the outdoor unit 1 shown in FIG. 1. The refrigerant flowing into the outdoor unit 1 is decompressed in the first decompressor 16A and second decompressor 16B and flows through the first heat source side heat exchanger 18A and second heat source side heat exchanger 18B. The refrigerant evaporated while flowing through the first heat source side heat exchanger 18A and second heat source side heat exchanger 18B is accumulated in the accumulator 26 via the first flow path selector 14A and second flow path selector 14B. The refrigerant accumulated in the accumulator 26 is sucked into the compressor 12 and compressed again.

Figure 3:
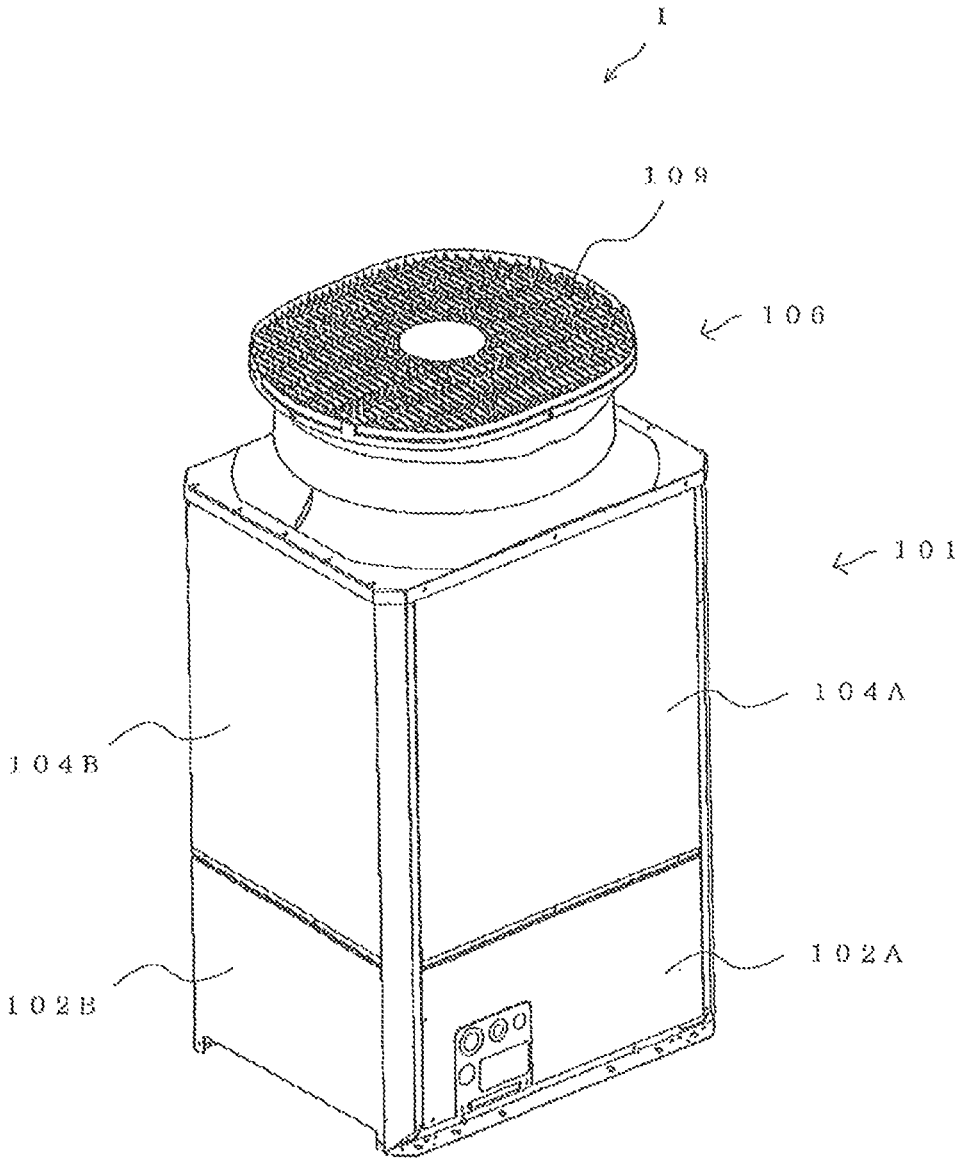
FIG. 3 is a diagram of a front face and left side face of the outdoor unit according to Embodiment 1 of the present invention as viewed obliquely.

Next, the outdoor unit 1 according to the present embodiment will be described more specifically. FIG. 3 is a diagram of a front face and left side face of the outdoor unit according to Embodiment 1 of the present invention as viewed obliquely, FIG. 4 is a diagram of a rear face and right side face of the outdoor unit shown in FIG. 3 as viewed obliquely, FIG. 5 is a diagram of an open-close panel taken out of the outdoor unit shown in FIG. 3 and viewed from the side of the front face, and FIG. 6 is a diagram showing a cross section of a heat exchange chamber of the outdoor unit shown in FIG. 3.

Figure 4:
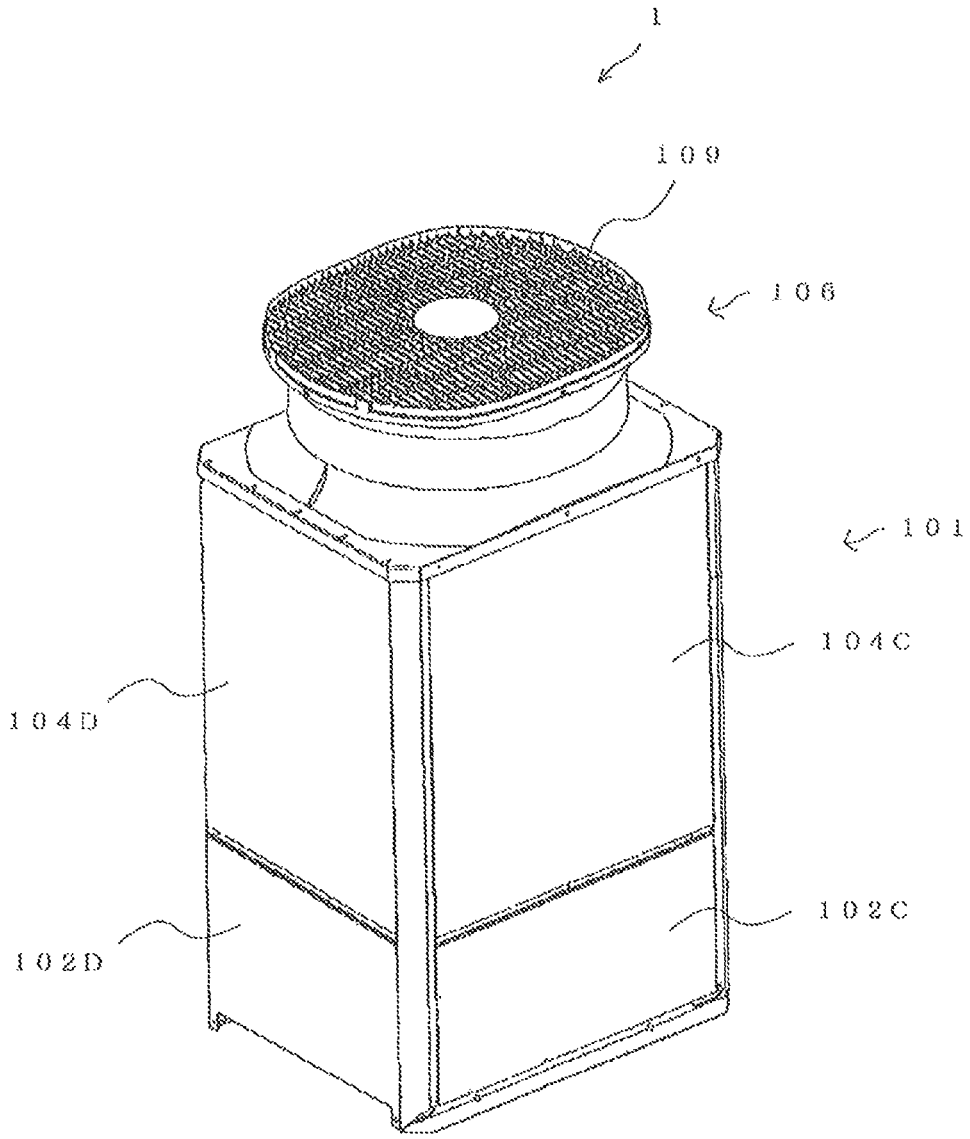
FIG. 4 is a diagram of a rear face and right side face of the outdoor unit shown in FIG. 3 as viewed obliquely.

As shown in FIGS. 3 and 4, the outdoor unit 1 according to the present embodiment includes a main unit 101 and a fan guard unit 106 provided in upper part of the main unit 101. The main unit 101 has, for example, a rectangular parallel piped shape, and as shown in FIG. 5, houses the heat source side heat exchanger 18, the compressor 12, an electrical component box 36, and non-illustrated refrigerant pipes and other pipes.

As shown in FIGS. 3 and 4, the upper part of the main unit 101 is covered with a front upper panel 104A, a left upper panel 104B, a rear upper panel 104C, and a right upper panel 104D. The front upper panel 104A, the left upper panel 104B, the rear upper panel 104C, and the right upper panel 104D are substantially flat-plate like members, making up an outer shell of upper part of the outdoor unit 1. The front upper panel 104A is disposed in upper part of a front face of the outdoor unit 1, the left upper panel 104B is disposed in upper part of a left side face of the outdoor unit 1, the rear upper panel 104C is disposed in upper part of a rear face of the outdoor unit 1, and the right upper panel 104D is disposed in upper part of a right side face of the outdoor unit 1. The front upper panel 104A, the left upper panel 104B, the rear upper panel 104C, and the right upper panel 104D are provided, for example, with plural air inlets (not illustrated) that allow air to pass therethrough and designed to be able to take air into the outdoor unit 1 from outside the outdoor unit 1. Note that although the outdoor unit 1 described in the present embodiment is a panel type outdoor unit, of which the outer shell of the upper part is configured to include the front upper panel 104A, the left upper panel 104B, the rear upper panel 104C, and the right upper panel 104D, the outdoor unit 1 of the present embodiment may be a frame type outdoor unit in which the upper panels described above are omitted.

Figure 5:
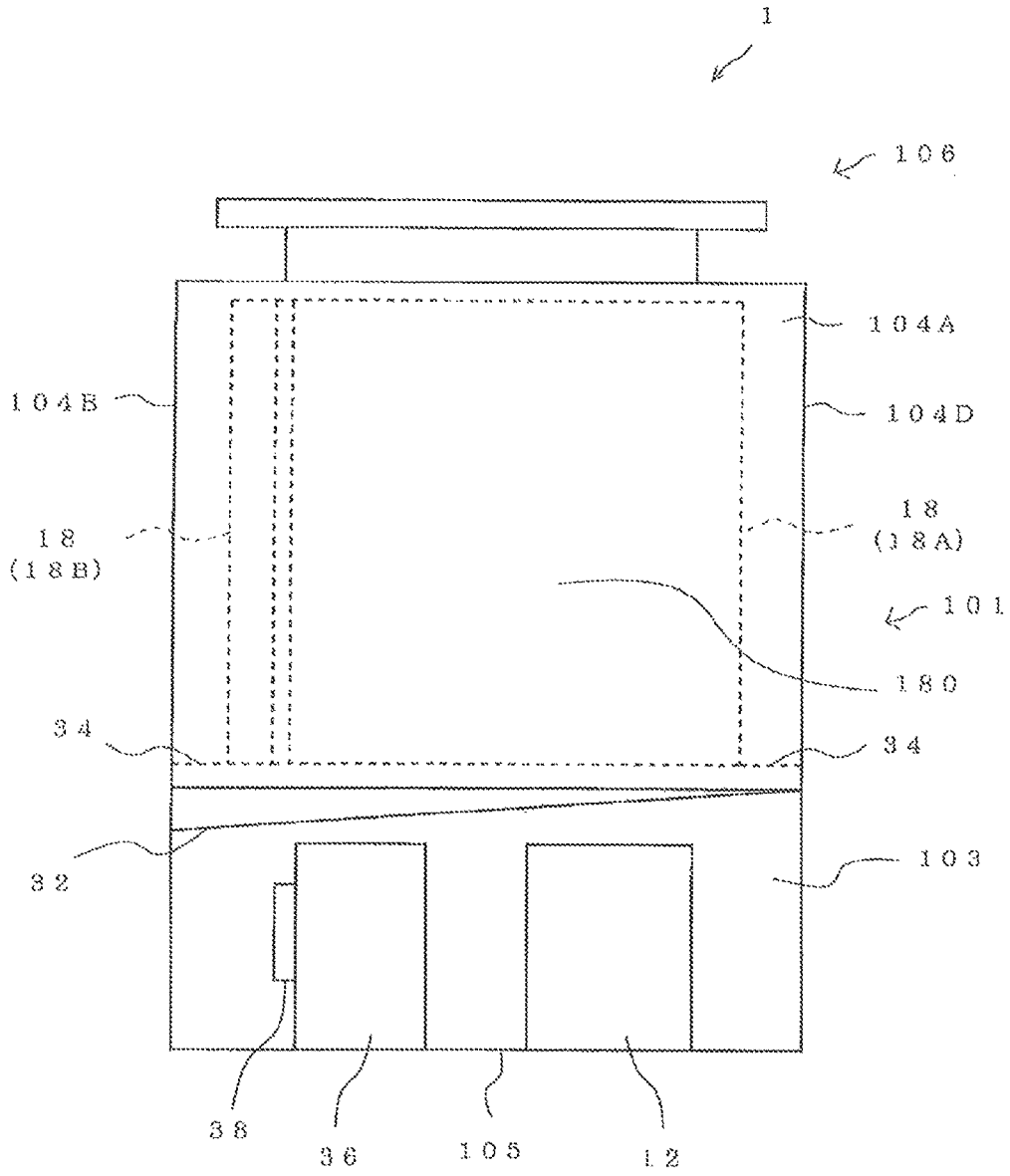
FIG. 5 is a diagram of an open-close panel taken out of the outdoor unit of FIG. 3 and viewed from the side of the front face.
Figure 6:
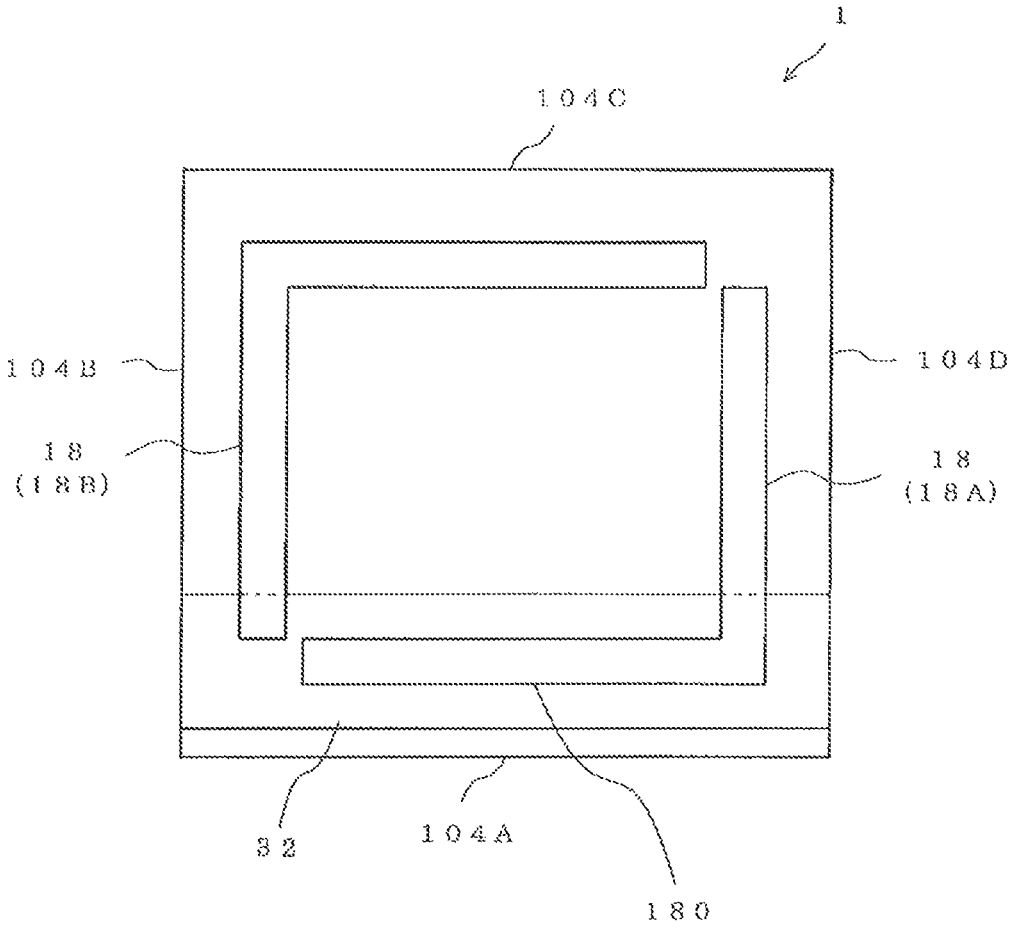
FIG. 6 is a diagram showing a cross section of a heat exchange chamber of the outdoor unit shown in FIG. 3.

As shown in FIG. 5, the heat source side heat exchanger 18 is disposed above a maintenance opening port 103. The heat source side heat exchanger 18 includes at least an open-close panel-facing heat exchange unit 180 located on the side of the front face of the outdoor unit 1. The open-close panel-facing heat exchange unit 180 faces a plane including an open-close panel 102A above the maintenance opening port 103. As shown in FIG. 6, the heat source side heat exchanger 18 in the example of the present embodiment includes the first heat source side heat exchanger 18A and second heat source side heat exchanger 18B. The first heat source side heat exchanger 18A has a single-bend shape and is installed facing the front upper panel 104A and right upper panel 104D. That part of the first heat source side heat exchanger 18A that faces the front upper panel 104A is the open-close panel-facing heat exchange unit 180. The second heat source side heat exchanger 18B has a single-bend shape and is installed facing the left upper panel 104B and rear upper panel 104C. As shown in FIG. 5, the heat source side heat exchanger 18 is mounted, for example, on a fixing member 34 below the heat source side heat exchanger 18. The fixing member 34 is, for example, a plate-like member mounted on a frame (not illustrated) extending in a vertical direction of the outdoor unit 1 and configured to support the heat exchange unit of the heat source side heat exchanger 18 from below, but may be a columnar member mounted on a base portion 105 being lower part of the outdoor unit 1. In the example of the present embodiment, a partition plate configured to partition between a room in which the heat source side heat exchanger 18 is installed and a room in which the compressor 12 and the like below the heat source side heat exchanger 18 are installed is not disposed. This improves flexibility of arrangement of the compressor 12, the electrical component box 36, and non-illustrated refrigerant pipes and other pipes.

As shown in FIGS. 3 and 4, the fan guard unit 106 has a cylindrical shape and houses a fan (not illustrated) inside. An air outlet 109 configured to blow air out of the outdoor unit 1 from inside of the outdoor unit 1 is formed in upper part of the fan guard unit 106. When the fan operates, outdoor air is taken into the outdoor unit 1 through the air inlets (not illustrated) formed in the front upper panel 104A, the left upper panel 104B, the rear upper panel 104C, and the right upper panel 104D. As shown in FIGS. 5 and 6, the air taken into the outdoor unit 1 undergoes heat exchange while passing through the heat source side heat exchanger 18, and is then discharged through the air outlet 109 shown in FIGS. 3 and 4. In the example of the present embodiment, aerodynamic performance has been improved because air is sucked uniformly from all around the outdoor unit 1 including a front face, both side faces, and a rear face of the outdoor unit 1. With the outdoor unit 1 in the example of the present embodiment, since the aerodynamic performance has been improved, electric power used to drive the fan is reduced, and noise produced when the fan is driven is reduced as well.

Lower part of the main unit 101 is covered with the open-close panel 102A, a left lower panel 102B, a rear lower panel 102C, and a right lower panel 102D. The open-close panel 102A, the left lower panel 102B, the rear lower panel 102C, and the right lower panel 102D are substantially flat-plate like members, making up an outer shell of the lower part of the outdoor unit 1. The open-close panel 102A is disposed in lower part of the front face of the outdoor unit 1, the left lower panel 102B is disposed in lower part of the left side face of the outdoor unit 1, the rear lower panel 102C is disposed in lower part of the rear face of the outdoor unit 1, and the right lower panel 102D is disposed in lower part of the right side face of the outdoor unit 1. The open-close panel 102A shown in FIG. 3 is attached openably and closably to the main unit 101, covering the maintenance opening port 103 shown in FIG. 5. By opening the open-close panel 102A, it is possible to perform maintenance and the like of the compressor 12, the electrical component box 36, and the like disposed inside the main unit 101, through the maintenance opening port 103. Note that the electrical component box 36 houses, for example, a control unit, an inverter, and the like, where the control unit controls the entire outdoor unit 1 while the inverter drives the compressor 12. The electrical component box 36 includes heat dissipation fins 38 configured to facilitate heat dissipation from the electrical component box 36.

[Drainage Channel]

As shown in FIG. 6, a drainage channel 32 is disposed at least below the open-close panel-facing heat exchange unit 180 of the heat source side heat exchanger 18. The drainage channel 32 is used to drain, for example, water such as condensation water generated in the heat source side heat exchanger 18, rainwater, or water generated during defrosting operation of the heat source side heat exchanger 18. The drainage channel 32 can be configured to include, for example, a first drainage unit 32A inclined downward toward the left side face of the outdoor unit 1 as shown in FIG. 6. The drainage channel 32 may be configured, for example, to receive water from above, cause the water to flow toward the left side face located on a downstream side of the outdoor unit 1, and drain the water out of the outdoor unit 1 from an outer side of the left lower panel 102B. Also, although not illustrated in FIG. 6, the drainage channel 32 may be configured to receive water from above in the first drainage unit 32A, cause the water to flow toward the left side face located on a downstream side of the outdoor unit 1, and then move the water downward on an inner side of the left lower panel 102B of the outdoor unit 1, and drain the water out of the outdoor unit 1 from the lower part of the outdoor unit 1. Although not illustrated in FIG. 6, the drainage channel 32 may be configured, for example, to include another drainage unit communicated with a downstream side of the first drainage unit 32A, extending vertically through the outdoor unit 1. The other drainage unit is configured as a second drainage unit 32B in Embodiment 2 described later. Note that the defrosting operation of the heat source side heat exchanger 18 is performed to thaw frost and the like adhering to the heat source side heat exchanger 18. The defrosting operation of the heat source side heat exchanger 18 is performed, for example, by heating the heat source side heat exchanger 18 with a non-illustrated heater. The defrosting operation of the heat source side heat exchanger 18 may be performed, for example, by switching the flow path selector 14 and thereby causing high-temperature refrigerant discharged from the compressor 12 to flow through the heat source side heat exchanger 18. Also, although in FIG. 6, the drainage channel 32 is configured to incline downward toward the left side face of the outdoor unit 1, the drainage channel 32 may be configured to incline downward toward the right side face of the outdoor unit 1. Note that although the drainage channel 32 is also used to drain rainwater in rainy weather, because the outdoor unit 1 is not located in a low outside air temperature environment in which there is a risk of temperature of the drainage channel 32 falling to or below a freezing point of water, there is no risk that the drainage channel 32 will be frozen.

When the heat source side heat exchanger 18 is serving as an evaporator, if the outdoor temperature falls, there is a risk that water will freeze in the drainage channel 32. If the freezing of water in the drainage channel 32 progresses, there are risks that the open-close panel 102A will freeze, failing to open or close, that the heat source side heat exchanger 18 located above the drainage channel 32 will be deformed or otherwise damaged or the like by ice, and so on. Thus, in the example of the present embodiment, as described below, a heating energy supply unit 50 disposed adjacent to, or in abutment with, the drainage channel 32 passes a fluid at a temperature higher than the freezing point of water to prevent the drainage channel 32 from becoming equal to or colder than the freezing point of water. Also, as described below with reference to FIG. 1, by disposing the heating energy supply unit 50 and drainage channel 32 such that a direction of the fluid passed by a refrigerant pipe interconnecting the expansion device 204 and heat source side heat exchanger 18 will be opposite a direction of water flowing through the drainage channel 32, the refrigerant pipe being an example of the heating energy supply unit 50, heat from the heating energy supply unit 50 is transmitted efficiently to the drainage channel 32.

[Heating Energy Supply Unit]

As shown in FIG. 1, a heating energy supply unit 50A according to the example of the present embodiment is made up of that part of the refrigerant pipe interconnecting the expansion device 204 and heat source side heat exchanger 18 that is located adjacent to, or in abutment with, the drainage channel 32. FIG. 1 schematically shows a positional relationship between the heating energy supply unit 50A according to the example of the present embodiment and the drainage channel 32, where the direction of the refrigerant flowing through the heating energy supply unit 50A is indicated by a solid arrow and the direction of water flowing through the drainage channel 32 is indicated by a dotted arrow, respectively. The refrigerant yet to flow into the heat source side heat exchanger 18 serving as an evaporator flows through the refrigerant pipe interconnecting the expansion device 204 and heat source side heat exchanger 18, which reduces the risk that temperature of the drainage channel 32 will fall to or below the freezing point of water. Note that as the refrigerant pipe interconnecting the expansion device 204 and the heat source side heat exchanger 18 is disposed in abutment with the drainage channel 32, heat from the heating energy supply unit 50A is transmitted efficiently to the drainage channel 32. Also, in the example of the present embodiment, the decompressor 16 is disposed in that part of the refrigerant pipe interconnecting the expansion device 204 and the heat source side heat exchanger 18 that is away from the drainage channel 32 and is close to the heat source side heat exchanger 18. When the heating energy supply unit 50A is configured such that that part of the refrigerant pipe interconnecting the expansion device 204 and the heat source side heat exchanger 18 in which the refrigerant yet to be decompressed by the decompressor 16 flows will be placed adjacent to, or in abutment with, the drainage channel 32, the risk that the temperature of the drainage channel 32 will fall to or below the freezing point of water is further reduced. Also, as shown in FIG. 1, in the example of the present embodiment, the refrigerant pipe interconnecting the expansion device 204 and heat source side heat exchanger 18 is placed in such a way as to cause the refrigerant higher in temperature than the freezing point of water to flow in an upstream direction from a downstream direction of the drainage channel 32, where the refrigerant pipe is the heating energy supply unit 50A. On a downstream side of the drainage channel 32, drain temperature is prone to become the lowest and a larger amount of drainage is produced than on an upstream side of the drainage channel 32, and consequently it is highly likely that the drainage channel 32 will freeze in a low outside air temperature environment. In the example of the present embodiment, by causing the refrigerant higher in temperature than the freezing point of water to flow from the downstream side of the drainage channel 32, it is possible to efficiently prevent freezing of the drainage channel 32 on the downstream side where drain water is prone to become the coldest, thereby making it possible to reduce a risk that water accumulating in a neighborhood of the open-close panel 102A will freeze.

As described above, in the outdoor unit 1 according to the example of the present embodiment, the heat source side heat exchanger 18 includes at least the open-close panel-facing heat exchange unit 180 facing a plane containing the open-close panel 102A. If water generated in the open-close panel-facing heat exchange unit 180 of the heat source side heat exchanger 18 is caused to drop down from the open-close panel-facing heat exchange unit 180, there is a risk that ice will be produced, for example, in the base portion 105, freezing the open-close panel 102A. Thus, in the example of the present embodiment, the drainage channel 32 is disposed at least below the open-close panel-facing heat exchange unit 180. The water drained from the drainage channel 32, which is disposed by being inclined downward toward a plane other than the plane containing the open-close panel 102A, is not drained to the neighborhood of the open-close panel 102A. Therefore, according to the present embodiment, a risk that water will accumulate in the neighborhood of the open-close panel 102A is reduced and the risk that water accumulating in the neighborhood of the open-close panel 102A will freeze is reduced as well, making it easy to carry out maintenance and the like of the outdoor unit 1 performed by opening the open-close panel 102A.

Also, in the example of the present embodiment, since the drainage channel 32 is disposed by being inclined downward toward a plane other than the plane containing the open-close panel 102A, a distance over which water flows through the drainage channel 32 is increased. Therefore, for example, when the heat source side heat exchanger 18 is serving as an evaporator, if the outdoor temperature falls, there is a risk that water will freeze in the drainage channel 32. If water freezes in the drainage channel 32, there are risks that it will become impossible to drain water, that water will overflow from the drainage channel 32 and freeze, causing the open-close panel 102A to freeze, and so on. This is because due to desirability of increasing heat exchange area of the heat source side heat exchanger 18, the open-close panel-facing heat exchange unit 180 is placed close to the plane containing the open-close panel 102A and the drainage channel 32 disposed below the open-close panel-facing heat exchange unit 180 is disposed adjacent to the open-close panel 102A. Thus, in the example of the present embodiment, the heating energy supply unit 50 configured to pass a fluid at a temperature higher than the freezing point of water is disposed adjacent to, or in abutment with, at least part of the drainage channel 32, thereby reducing the risk that the temperature of the drainage channel 32 will fall to or below the freezing point of water. Specifically, in the example of the present embodiment, the heating energy supply unit 50A is made up of the refrigerant pipe interconnecting the expansion device 204 and heat source side heat exchanger 18. Since the refrigerant pipe through which the refrigerant yet to flow into the heat source side heat exchanger 18 serving as an evaporator flows is disposed adjacent to, or in abutment with, at least part of the drainage channel 32, the risk that the temperature of the drainage channel 32 will fall to or below the freezing point of water is reduced.

Also, in the example of the present embodiment, the decompressor 16 is disposed in that part of the refrigerant pipe interconnecting the expansion device 204 and the heat source side heat exchanger 18 that is away from the drainage channel 32 and is close to the heat source side heat exchanger 18. Since the refrigerant pipe of the refrigerant pipe interconnecting the expansion device 204 and heat source side heat exchanger 18 in which the refrigerant yet to be decompressed by the decompressor 16 flows is placed adjacent to, or in abutment with, the drainage channel 32, the risk that the temperature of the drainage channel 32 will fall to or below the freezing point of water is further reduced. Note that when the decompressor 16 is made up of a motor-operated valve or the like whose opening degree is adjustable, the opening degree of the decompressor 16 can be adjusted using pressure and temperature of the refrigerant flowing through the refrigerant pipe interconnecting the expansion device 204 and heat source side heat exchanger 18. By adjusting the opening degree of the decompressor 16, the temperature of the refrigerant yet to be decompressed by the decompressor 16 can be preferably adjusted, making it possible to further reduce the risk that the temperature of the drainage channel 32 will fall to or below the freezing point of water. Note that, not only the opening degree of the decompressor 16, but also an opening degree of the expansion device 204 can be adjusted. For example, the pressure of the refrigerant is measured with a non-illustrated pressure measuring device and the temperature of the refrigerant is measured with a non-illustrated temperature measuring device.

The present embodiment is not limited to the configuration of the above description. For example, the heating energy supply unit 50 may be configured by using a branch pipe branching off from the refrigerant pipe interconnecting the expansion device 204 and heat source side heat exchanger 18 and by placing the branch pipe adjacent to, or in abutment with, the drainage channel 32.

Also, although the heat source side heat exchanger 18 made up of the first heat source side heat exchanger 18A having a single-bend shape and the second heat source side heat exchanger 18B having a single-bend shape has been described above, the heat source side heat exchanger 18 may be made up of a single heat exchanger having a three-bend shape or may be made up of four heat exchangers having no bent shape. That is, it is enough that the heat source side heat exchanger 18 according to the present embodiment is disposed on all sides of the outdoor unit in top view as shown in FIG. 6. That is, it is enough that the heat source side heat exchanger 18 according to the present embodiment includes heat exchange units facing the front upper panel 104A, the left upper panel 104B, the rear upper panel 104C, and the right upper panel 104D, respectively.

Also, although an example in which the open-close panel 102A and maintenance opening port 103 are disposed in the lower part of the front face of the outdoor unit 1 has been described above, it is enough that the open-close panel 102A and maintenance opening port 103 are disposed in the lower part of any of the front face, the left side face, the rear face, and the right side face of the outdoor unit 1. Also, the open-close panel 102A and maintenance opening port 103 may be disposed in the lower part of two or more of the front face, the left side face, the rear face, and the right side face of the outdoor unit 1.

Embodiment 2

Figure 7:
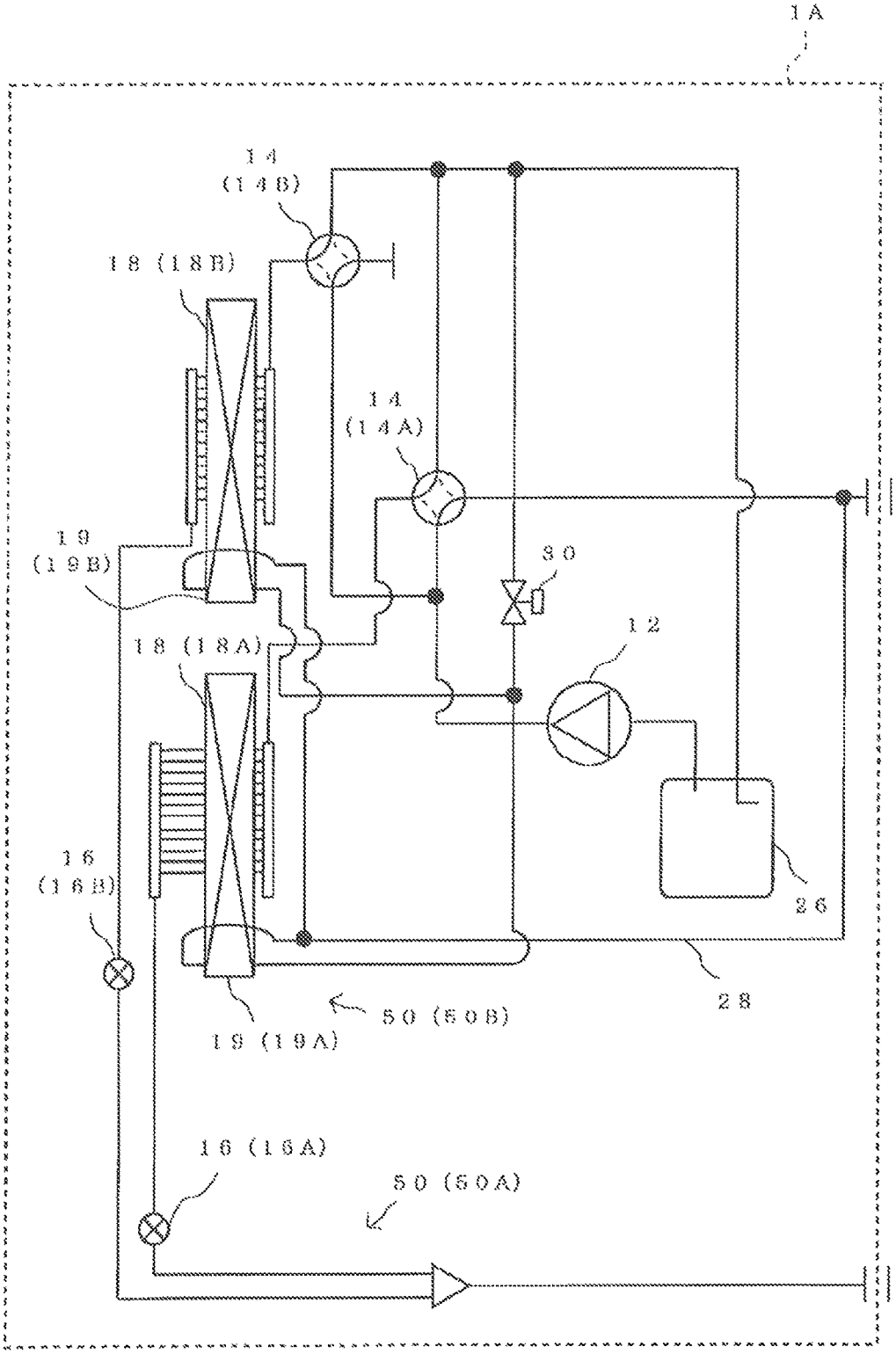
FIG. 7 is a diagram showing an example of a configuration of an outdoor unit according to Embodiment 2 of the present invention.

FIG. 7 is a diagram showing an example of a configuration of an outdoor unit according to Embodiment 2 of the present invention. Note that in the outdoor unit 1A shown in FIG. 7, components having the same configuration as the corresponding components of the outdoor unit 1 shown in FIG. 1 are denoted by the same reference numerals as the corresponding components, and description thereof will be omitted. The outdoor unit 1A of FIG. 7 differs from the outdoor unit 1 of FIG. 1 in that the outdoor unit 1A of FIG. 7 further includes an auxiliary heat exchanger 19 and a branch pipe 28A.

The auxiliary heat exchanger 19 is connected with the branch pipe 28A and configured to exchange heat with the refrigerant flowing in from the branch pipe 28A. The auxiliary heat exchanger 19 is disposed below the heat source side heat exchanger 18. The auxiliary heat exchanger 19 and heat source side heat exchanger 18 are constructed, for example, integrally and provided in different areas of common fins. Note that the auxiliary heat exchanger 19 and heat source side heat exchanger 18 may be constructed as separate units. The auxiliary heat exchanger 19 in the example of the present embodiment includes a first auxiliary heat exchanger 19A and a second auxiliary heat exchanger 19B.

The branch pipe 28A is connected to the auxiliary heat exchanger 19 by branching off from a refrigerant pipe interconnecting the compressor 12 and use side heat exchanger 202 via the first flow path selector 14A. In the example shown in FIG. 7, the branch pipe 28A is connected to the auxiliary heat exchanger 19 by branching off from a refrigerant pipe interconnecting the first flow path selector 14A and the use side heat exchanger 202 located on a downstream side of the first flow path selector 14A. The branch pipe 28A is provided with a valve 30 configured to control refrigerant inflow into the auxiliary heat exchanger 19. Note that although the valve 30 may be disposed upstream of the auxiliary heat exchanger 19, it is advisable to dispose the valve 30 downstream of the auxiliary heat exchanger 19 as shown in FIG. 7. When the valve 30 is disposed downstream of the auxiliary heat exchanger 19, refrigerant higher in pressure and temperature can be made to flow to the auxiliary heat exchanger 19 than when the valve 30 is disposed upstream of the auxiliary heat exchanger 19. The valve 30 is, for example, an open/close selector valve configured to switch between an open state and closed state by performing open/close operation, but when the valve 30 is made up of a motor-operated valve or the like capable of adjusting the opening degree, a flow rate of the refrigerant flowing into the auxiliary heat exchanger 19 can be adjusted.

Figure 8:
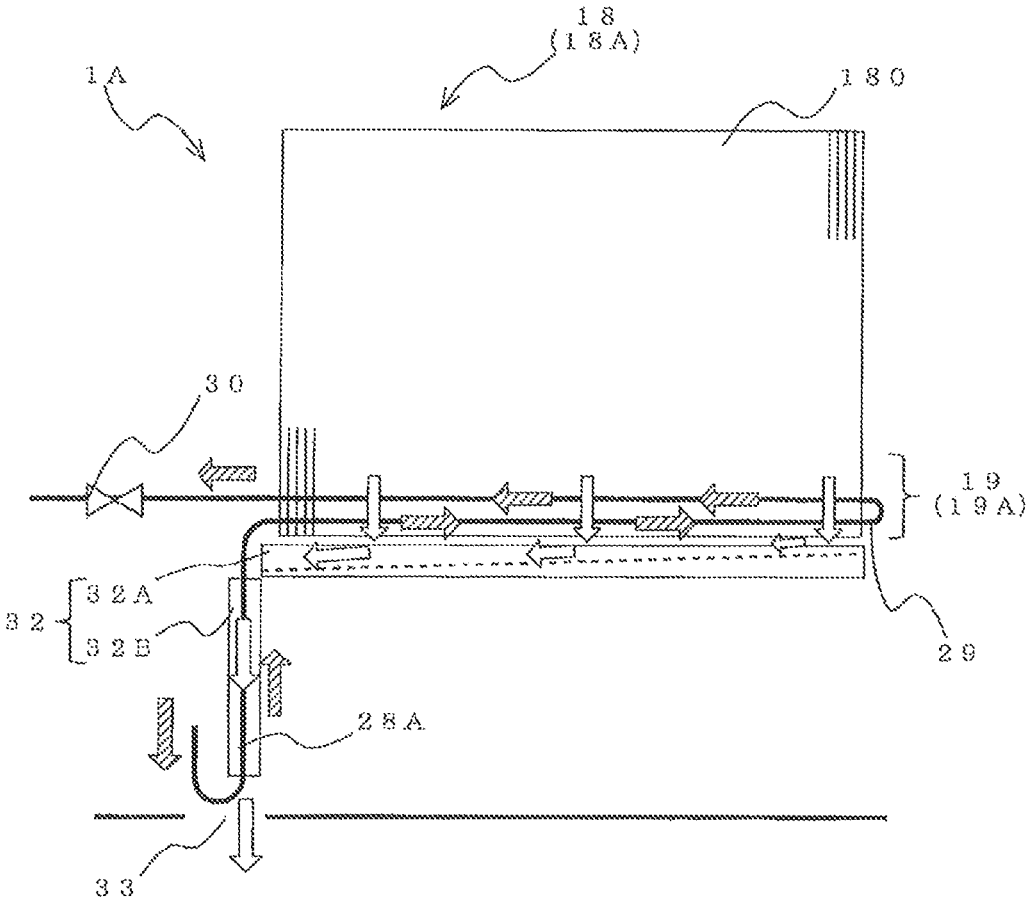
FIG. 8 is a schematic diagram showing an example of a configuration of a heating energy supply unit according to Embodiment 2 of the present invention.
Figure 9:
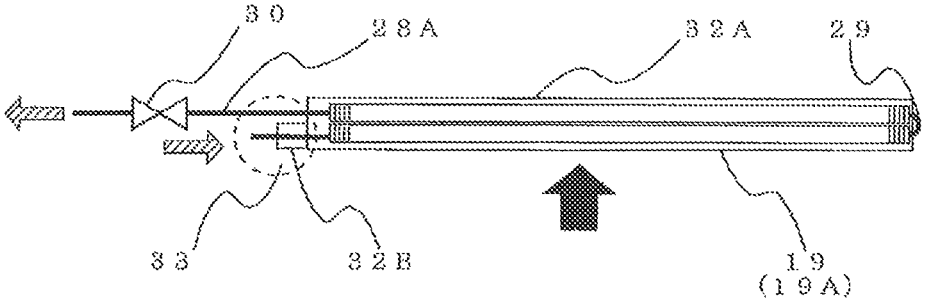
FIG. 9 is a schematic diagram showing an example of a configuration of an auxiliary heat exchanger according to Embodiment 2 of the present invention in top view.

FIG. 8 is a schematic diagram showing an example of a configuration of a heating energy supply unit 50B according to Embodiment 2 of the present invention. In FIG. 8, flow of refrigerant is indicated by shaded block arrows and flow of drain is indicated by white block arrows. FIG. 9 is a schematic diagram showing an example of a configuration of the auxiliary heat exchanger 19 according to Embodiment 2 in top view. In FIG. 9, flow of refrigerant is indicated by a shaded block arrow and flow of air passing through the heat source side heat exchanger 18 is indicated by a white block arrow.

As shown in FIG. 8, the drainage channel 32 can be configured to include a first drainage unit 32A inclined downward toward the left side face of the outdoor unit 1A, and a second drainage unit 32B communicated with the downstream side of the first drainage unit 32A and extending vertically through the outdoor unit 1A and used to discharge drain water through a drainage base hole 33 provided in a bottom face of the outdoor unit 1A. Also, the auxiliary heat exchanger 19 is configured to include part of the branch pipe 28A as a heat transfer tube 29. Also, the auxiliary heat exchanger 19 is disposed adjacent to, or in abutment with, at least part of the first drainage unit 32A. Also, that part of the branch pipe 28A that does not make up the heat transfer tube 29 of the auxiliary heat exchanger 19 is disposed adjacent to, or in abutment with, at least part of the second drainage unit.

Also, as shown in FIG. 9, the heat transfer tube 29 is configured to pass refrigerant higher in temperature than the freezing point of water in an upstream direction from a downstream direction of the first drainage unit 32A at least on the side of the open-close panel 102A of the outdoor unit 1A. That part of the auxiliary heat exchanger 19 that is on the side of the open-close panel 102A of the outdoor unit 1A is liable to frost formation, and can be defrosted efficiently by pass refrigerant higher in temperature than the freezing point of water.

As described above, the heating energy supply unit 50B according to the example of the present embodiment is configured to include that part of the branch pipe 28A that is located adjacent to, or in abutment with, the second drainage unit 32B of the drainage channel 32 as well as includes the auxiliary heat exchanger 19. That is, when the branch pipe 28A, through which the high-temperature refrigerant discharged from the compressor 12 flows, is placed adjacent to, or in abutment with, the second drainage unit 32B of the drainage channel 32, the second drainage unit 32B of the drainage channel 32 is heated. Also, because the high-temperature refrigerant discharged from the compressor 12 flows through the auxiliary heat exchanger 19 connected with the branch pipe 28A, the first drainage unit 32A of the drainage channel 32 disposed below the heat source side heat exchanger 18 and auxiliary heat exchanger 19 is heated by conductive heat, radiant heat, and other heat from the fins of the auxiliary heat exchanger 19. Note that it is advisable to operate the heating energy supply unit 50B in the example of the present embodiment only when there is a risk that water will freeze in the drainage channel 32, to pass the refrigerant to the branch pipe 28A by opening the valve 30 and thereby heat the drainage channel 32. For example, after defrosting operation of the heat source side heat exchanger 18, the valve 30 is opened for a set time set in advance, to pass refrigerant to the branch pipe 28A and thereby heat the drainage channel 32.

The present embodiment is not limited to the above description. For example, although in the example of FIG. 7, the heating energy supply unit 50 is configured to include the heating energy supply unit 50B as well as the heating energy supply unit 50A described in Embodiment 1, the heating energy supply unit 50A may be omitted. Also, although in the example described above, the heating energy supply unit 50B is configured to include that part of the branch pipe 28A that is located adjacent to, or in abutment with, the drainage channel 32 as well as include the auxiliary heat exchanger 19, it is enough that the heating energy supply unit 50B is configured to include at least one of that part of the branch pipe 28A that is located adjacent to, or in abutment with, the second drainage unit 32B of the drainage channel 32 and the auxiliary heat exchanger 19. When the heating energy supply unit 50B is configured to include that part of the branch pipe 28A that is located adjacent to, or in abutment with, the drainage channel 32, the auxiliary heat exchanger 19 may be omitted.

Embodiment 3

Figure 10:
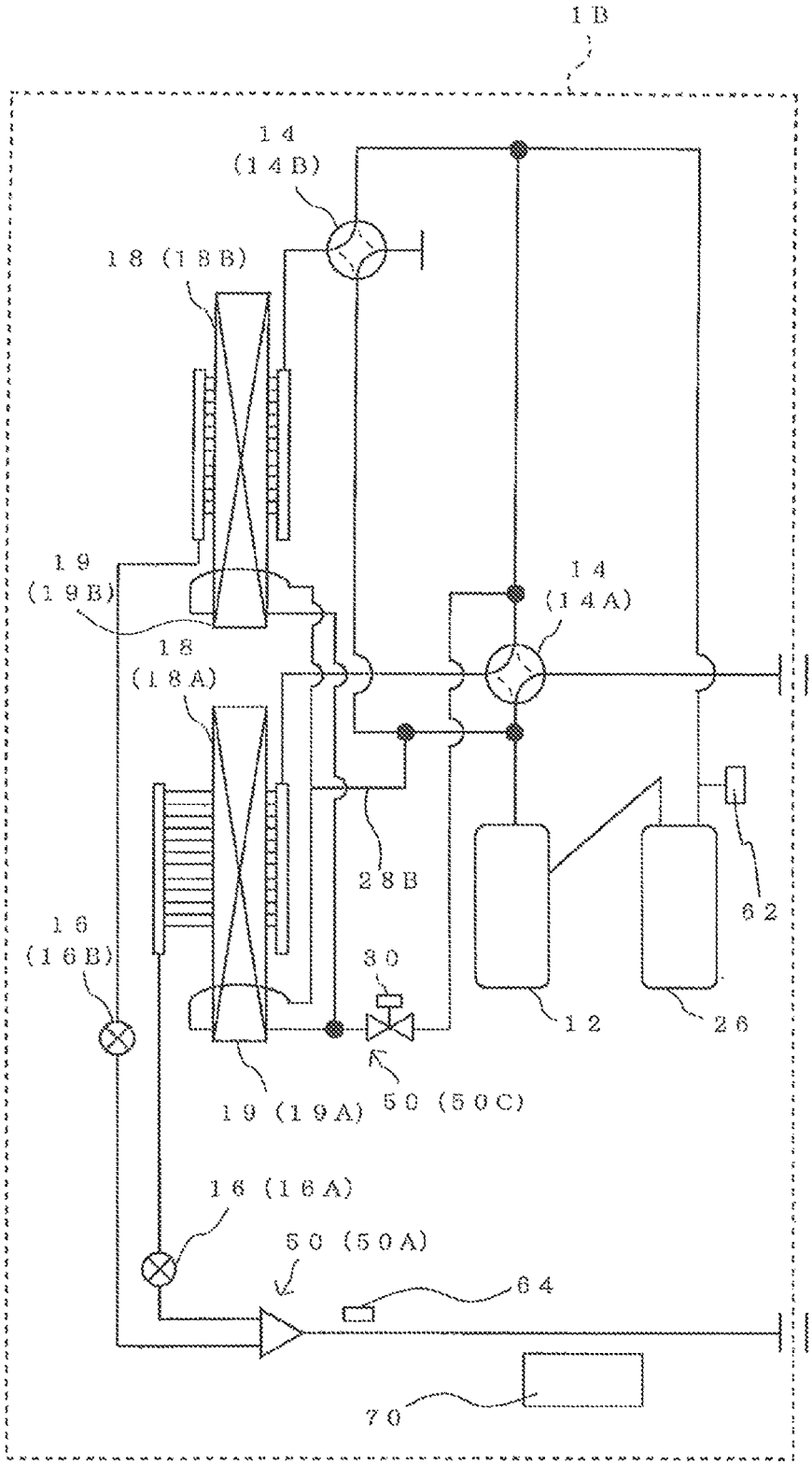
FIG. 10 is a diagram showing an example of a configuration of an outdoor unit according to Embodiment 3 of the present invention.

FIG. 10 is a diagram showing an example of a configuration of an outdoor unit 1B according to Embodiment 3 of the present invention. Note that in the outdoor unit 1B shown in FIG. 10, components having the same configuration as the corresponding components of the outdoor unit 1A shown in FIG. 7 are denoted by the same reference numerals as the corresponding components, and description thereof will be omitted. The outdoor unit 1B of FIG. 10 differs from the outdoor unit 1A of FIG. 7 in that the outdoor unit 1B of FIG. 10 includes a branch pipe 28B connected to the auxiliary heat exchanger 19 by branching off from a refrigerant pipe interconnecting the first flow path selector 14A and the compressor 12 located on an upstream side of the first flow path selector 14A as well as includes a pressure sensor 62, a temperature sensor 64, and a controller 70. Because the branch pipe 28B branches off from between the first flow path selector 14A and the compressor 12, with the first flow path selector 14A being placed between the compressor 12 and use side heat exchanger 202, the branch pipe 28B can heat the drainage channel 32 by passing high-temperature refrigerant through the branch pipe 28B even during the defrosting operation in which high-temperature refrigerant discharged from the compressor 12 is passed through the heat source side heat exchanger 18.

In Embodiment 3, the defrosting operation in which the high-temperature refrigerant discharged from the compressor 12 is passed through the heat source side heat exchanger 18 is carried out as the controller 70 controls switching operation of the flow path selector 14 and valve 30 based on information from timers and the like provided in the pressure sensor 62, temperature sensor 64, and controller 70.

The pressure sensor 62 is a low-pressure sensor placed on a refrigerant pipe on an inlet port side of the accumulator 26 and configured to detect pressure of low-pressure refrigerant sucked into the compressor 12 via the accumulator 26. Examples of materials available for the pressure sensor 62 include a piezoelectric quartz pressure sensor, a semiconductor sensor, and a pressure transducer.

The temperature sensor 64 is designed to measure temperatures of refrigerant through a refrigerant pipe, measuring the temperature of the refrigerant flowing out of the use side heat exchanger 202 via the expansion device 204 during heating operation and measuring the temperature of the refrigerant flowing out of the heat source side heat exchanger 18 via the decompressor 16 during cooling operation. Examples of materials available for the temperature sensor 64 include semiconductor materials such as thermistors and metallic materials such as resistance temperature detectors.

The controller 70 is configured to control operation of the flow path selector 14 and valve 30 as well as operation of the entire refrigeration cycle apparatus, including for example, start and stop of the refrigeration cycle apparatus, capacity control for the compressor 12, and opening degree control for the decompressor 16. Also, the controller 70 is configured to be able to receive pressure information detected by the pressure sensor 62 and temperature information detected by the temperature sensor 64.

The controller 70 is configured as a microcomputer or microprocessing unit equipped with dedicated hardware, or a central processing unit, a memory, and the like. The controller 70 is housed, for example, in the electrical component box 36 or the like. Note that an internal structure of the controller 70 is not illustrated in FIG. 10.

When configured as dedicated hardware, the controller 70 can be made up, for example, of a single circuit, a composite circuit, an ASIC, an FPGA, or a combination thereof. The controller 70 may be configured to be able to implement individual control processes using separate pieces of hardware or configured to perform all the control processes on a single piece of hardware. Note that "ASIC" is an abbreviation for an application-specific integrated circuit while "FPGA" is an abbreviation for a field-programmable gate array.

When the controller 70 is configured as a microcomputer or microprocessing unit, the control processes performed by the controller 70 are implemented by software, firmware, or a combination of software and firmware. The software or firmware is described as a control program. The memory is configured as a storage unit configured to store the control program for the controller 70. The memory can be configured, for example, as a non-volatile memory such as a RAM, ROM, flash memory, or EPROM, EEPROM or as a volatile semiconductor memory. The central processing unit is configured as a computing unit configured to implement control processes by executing the control program stored in and read out of the memory. Note that the central processing unit is abbreviated to "CPU." The central processing unit is also referred to as a processing unit, arithmetic unit, microprocessor, or processor.

Also, the controller 70 may be configured such that part of the control processes will be implemented by dedicated hardware and that remaining control processes will be implemented by a microcomputer or a microprocessing unit.

Next, a control process performed by the controller 70 during defrosting operation in Embodiment 3 will be described.

Figure 11:
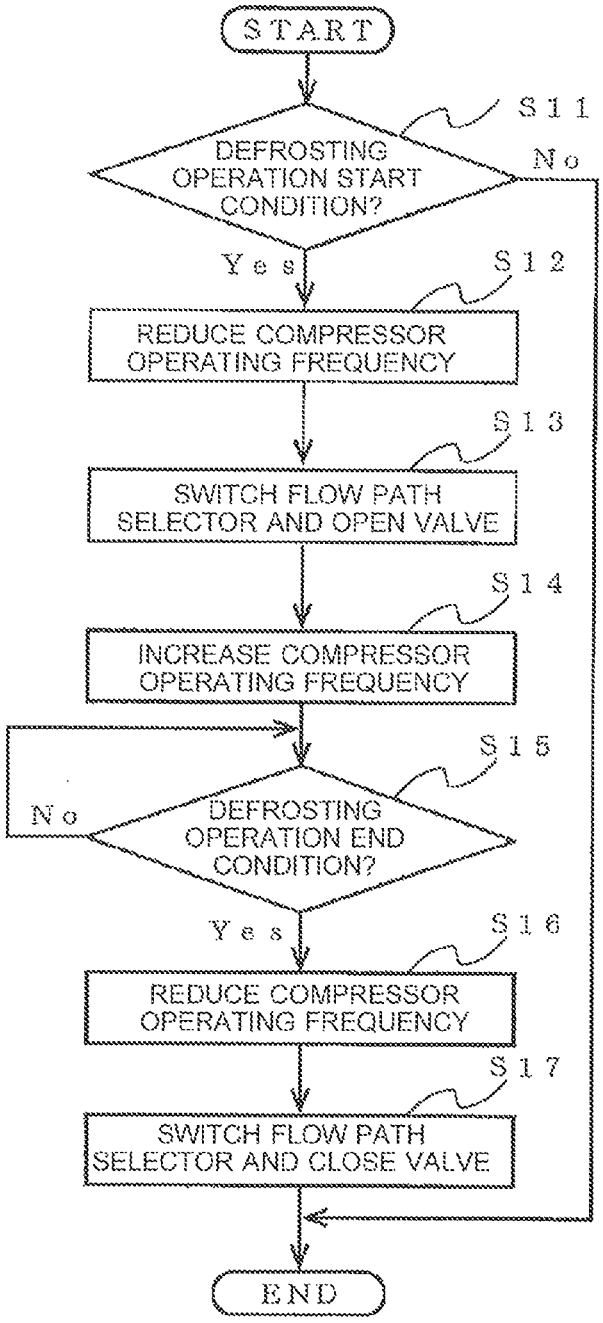
FIG. 11 is a control flowchart showing an example of a control process according to Embodiment 3 of the present invention.

FIG. 11 is a control flowchart showing an example of a control process according to Embodiment 3 of the present invention. A time or time zone at/during which defrosting operation is performed can be set, for example, by a timer function or scheduling function of the controller 70. Also, the controller 70 can be configured to be able to repeat the control process of FIG. 11 at predetermined time intervals, for example, at intervals of one hour during heating operation.

In step S11, the controller 70 determines whether a defrosting operation start condition is satisfied. During heating operation, for example, when the low pressure of the refrigerant detected by the pressure sensor 62 is 0.15 MPa or below or the refrigerant temperature detected by the temperature sensor 64 is −8 degrees C. or below, the controller 70 determines that the defrosting operation start condition is satisfied. When the defrosting operation start condition is not satisfied, the control process is finished and normal heating operation is continued.

When it is determined that the defrosting operation start condition is satisfied, in step S12, to switch the flow path selector 14 safely, the controller 70 performs control for reducing operating frequency of the compressor 12. For example, the controller 70 performs control for reducing the operating frequency of the compressor 12 from 100 Hz to about 30 Hz. Next, in step S13, the controller 70 performs control for switching the flow path selector 14 and opening the valve 30, and thereby starts the defrosting operation. Next, in step S14, the controller 70 performs control for increasing the operating frequency of the compressor 12. For example, the controller 70 performs control for returning the operating frequency of the compressor 12 from 30 Hz to about 100 Hz.

In step S15, the controller 70 determines whether a defrosting operation end condition is satisfied. During defrosting operation, for example, when the refrigerant temperature detected by the temperature sensor 64 is 25 degrees C. or above, the controller 70 determines that the defrosting operation end condition is satisfied. Also, by using a timer, the controller 70 can be configured to determine that the defrosting operation end condition is satisfied when a predetermined time, for example, 10 minutes, has elapsed after the defrosting operation starts. When the defrosting operation end condition is not satisfied, the control process of step S15 is repeated at predetermined time intervals, for example, at intervals of one minute.

When it is determined that the defrosting operation end condition is satisfied, in step S16, to switch the flow path selector 14 safely, the controller 70 performs control for reducing operating frequency of the compressor 12. For example, the controller 70 performs control for reducing the operating frequency of the compressor 12 from 100 Hz to about 30 Hz. Next, in step S17, the controller 70 performs control for switching the flow path selector 14 and closing the valve 30, and thereby finishes the defrosting operation and resumes normal heating operation.

Note that the present embodiment is not limited to the above description. For example, although in the example of FIG. 10, the heating energy supply unit 50 is configured to include a heating energy supply unit 50C as well as the heating energy supply unit 50A described in Embodiment 1, the heating energy supply unit 50A may be omitted. Also, although in the example described above, the heating energy supply unit 50C is configured to include that part of the branch pipe 28B that is located adjacent to, or in abutment with, the drainage channel 32 as well as include the auxiliary heat exchanger 19, it is enough that the heating energy supply unit 50C is configured to include at least one of that part of the branch pipe 28B that is located adjacent to, or in abutment with, the second drainage unit 32B of the drainage channel 32 and the auxiliary heat exchanger 19. When the heating energy supply unit 50C is configured to include that part of the branch pipe 28B that is located adjacent to, or in abutment with, the drainage channel 32, the auxiliary heat exchanger 19 may be omitted.

Embodiment 4

Figure 12:
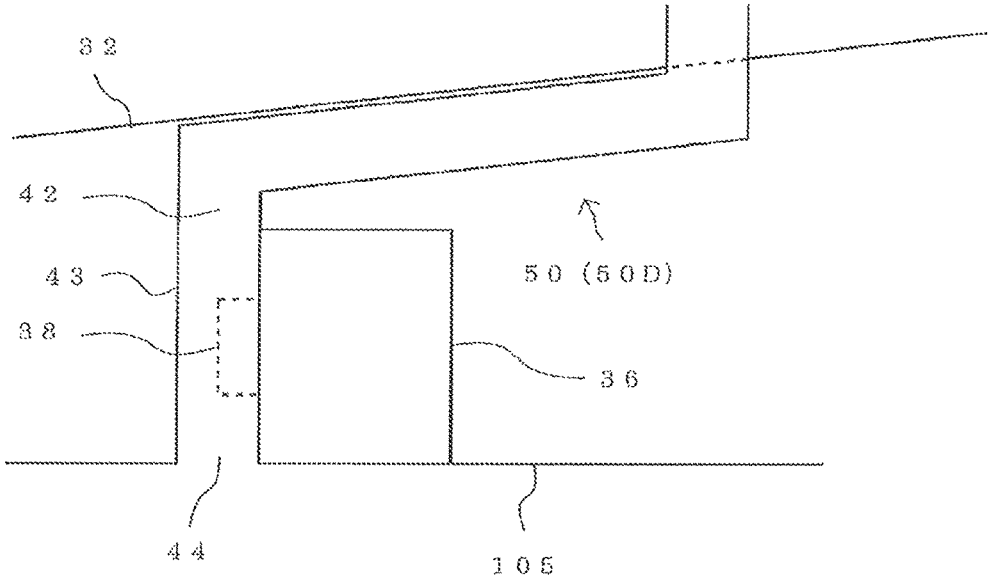
FIG. 12 is a diagram describing an example of a configuration of a heating energy supply unit according to Embodiment 4 of the present invention.

FIG. 12 is a diagram describing an example of a configuration of a heating energy supply unit according to Embodiment 4 of the present invention. As shown in FIG. 12, a heating energy supply unit 50D according to the example of the present embodiment is configured to include an air channel 42 configured to discharge heat produced by the electrical component box 36. The air channel 42 is configured to include a duct 43 configured to take in air through an opening port 44 formed in the base portion 105 and pass the intake air to a neighborhood of the drainage channel 32. Air flow is generated in the duct 43 when a fan disposed inside the fan guard unit 106 shown in FIG. 3 operates. As shown in FIG. 12, at least part of the heat dissipation fins 38 configured to facilitate heat dissipation from the electrical component box 36 is disposed in the duct 43 and heat dissipation from the electrical component box 36 is further facilitated by air flowing through the duct 43. Also, because the air in the duct 43 heated by the electrical component box 36 heats the drainage channel 32, a risk that the drainage channel 32 will freeze is reduced as well. Note that the electrical component box 36, which generates heat at temperatures higher than at least the freezing point of water, corresponds to a "heating element" of the present invention.

The present invention is not limited to the above embodiments, and various changes can be made without departing from the scope of the present invention. That is, the configurations of the above embodiments may be improved as appropriate and at least part of the configurations may be substituted with another configuration. Furthermore, components whose arrangement is not limited specifically are not limited to the arrangement disclosed in the embodiments and may be placed at positions where the functions of the components can be achieved.

For example, the heating energy supply unit 50D described in Embodiment 4 can be added and applied to Embodiments 1 to 3.

The invention claimed is:

1. An outdoor unit being part of a refrigeration cycle apparatus in which refrigerant circulates and having a maintenance opening port, comprising:

an open-close panel attached openably and closably to the outdoor unit and configured to cover the maintenance opening port;

a heat source side heat exchanger disposed above the maintenance opening port and provided at least with an open-close panel-facing heat exchanger facing a plane containing the open-close panel;

a drainage channel provided with a first drainage unit, the first drainage unit being located at least below the open-close panel-facing heat exchanger of the heat source side heat exchanger and inclined downward toward a plane other than the plane containing the open-close panel; and a heating energy supply unit disposed adjacent to, or in abutment with, at least part of the drainage channel, wherein a refrigerant pipe is a branch pipe branching off from between a compressor of the refrigeration cycle apparatus and a use side heat exchanger of the refrigeration cycle apparatus, the heating energy supply unit includes the refrigerant pipe configured to pass refrigerant higher in temperature than a freezing point of water in an upstream direction from a downstream direction of the drainage channel, before flowing into the heat source side heat exchanger, and the heating energy supply unit further includes an auxiliary heat exchanger disposed below the heat source side heat exchanger and equipped with part of the branch pipe as a heat transfer tube.

2. The outdoor unit of claim 1, wherein the heat source side heat exchanger is disposed against all sides of the outdoor unit in top view.

3. The outdoor unit of claim 1, wherein the refrigerant pipe is a pipe interconnecting an expansion valve and the heat source side heat exchanger in the refrigeration cycle apparatus.

4. The outdoor unit of claim 3, further comprising a decompressor configured to reduce pressure of the refrigerant and disposed in that part of the refrigerant pipe interconnecting the expansion valve and the heat source side heat exchanger, the part being away from the drainage channel and is close to the heat source side heat exchanger.

5. The outdoor unit of claim 1, wherein the auxiliary heat exchanger is disposed adjacent to, or in abutment with, at least part of the first drainage unit, and refrigerant higher in temperature than a freezing point of water is passed in an upstream direction from a downstream direction of the first drainage unit through the heat transfer tube at least on a side of the open-close panel of the outdoor unit.

6. The outdoor unit of claim 1, wherein the drainage channel includes a second drainage unit communicated with a downstream side of the first drainage unit and extending vertically through the outdoor unit, and that part of the branch pipe that does not constitute the heat transfer tube of the auxiliary heat exchanger is disposed adjacent to, or in abutment with, at least part of the second drainage unit.

7. The outdoor unit of claim 1, wherein the heat source side heat exchanger and the auxiliary heat exchanger are provided in different areas of common fins.

8. An outdoor unit being part of a refrigeration cycle apparatus in which refrigerant circulates and having a maintenance opening port, comprising:

an open-close panel attached openably and closably to the outdoor unit and configured to cover the maintenance opening port;

a heat source side heat exchanger disposed above the maintenance opening port and provided at least with an open-close panel-facing heat exchanger facing a plane containing the open-close panel;

a drainage channel provided with a first drainage unit, the first drainage unit being located at least below the open-close panel-facing heat exchanger of the heat source side heat exchanger and inclined downward toward a plane other than the plane containing the open-close panel;

a heating energy supply unit disposed adjacent to, or in abutment with, at least part of the drainage channel, the heating energy supply unit further includes an air channel through which air heated by the heating element flows; and a heating element configured to generate heat at temperatures higher than the freezing point of water, wherein the heating energy supply unit includes a refrigerant pipe configured to pass refrigerant higher in temperature than a freezing point of water in an upstream direction from a downstream direction of the drainage channel, before flowing into the heat source side heat exchanger.

9. The outdoor unit of claim 8, further comprising a duct configured to form the air channel.

10. The outdoor unit of claim 8, wherein the heating element includes an inverter configured to drive the compressor of the refrigeration cycle apparatus.

11. The outdoor unit of claim 8, wherein the heating element includes heat dissipation fins configured to facilitate heat dissipation from the heating element, and at least part of the heat dissipation fins is disposed in the air channel.

12. The outdoor unit of claim 8, wherein the refrigerant pipe is a branch pipe branching off from between a compressor of the refrigeration cycle apparatus and a use side heat exchanger of the refrigeration cycle apparatus.

13. The outdoor unit of claim 12, wherein the branch pipe branches off from between a flow path selector of the refrigeration cycle apparatus and the use side heat exchanger of the refrigeration cycle apparatus, the flow path selector being placed between the compressor of the refrigeration cycle apparatus and the use side heat exchanger of the refrigeration cycle apparatus.

14. The outdoor unit of claim 12, wherein the branch pipe branches off from between a flow path selector of the refrigeration cycle apparatus and the compressor of the refrigeration cycle apparatus, the flow path selector being placed between the compressor of the refrigeration cycle apparatus and the use side heat exchanger of the refrigeration cycle apparatus.

* * * * *